US012760645B2

(12) United States Patent
Kevadiya et al.

(10) Patent No.: US 12,760,645 B2
(45) Date of Patent: Oct. 13, 2026

(54) GAS COMPOSITION FROM A DRILLING FLUID DENSITY CHANGE

(71) Applicant: Halliburton Energy Services, Inc., Houston, TX (US)

(72) Inventors: Jhanvi Manishkumar Kevadiya, Houston, TX (US); Mathew Dennis Rowe, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 972 days.

(21) Appl. No.: 18/082,273

(22) Filed: Dec. 15, 2022

(65) Prior Publication Data

US 2024/0200444 A1 Jun. 20, 2024

(51) Int. Cl.
*E21B 49/08* (2006.01)
*E21B 21/08* (2006.01)

(52) U.S. Cl.
CPC ..... *E21B 49/0875* (2020.05); *E21B 21/08* (2013.01)

(58) Field of Classification Search
None
See application file for complete search history.

(56) References Cited

U.S. PATENT DOCUMENTS 4,535,851 A * 8/1985 Kirkpatrick ..... E21B 21/08 175/218
4,833,914 A * 5/1989 Rasmus ..... E21B 21/08 73/152.52
2014/0202772 A1 7/2014 Kulkarni et al.
(Continued)

FOREIGN PATENT DOCUMENTS

AU 2013274009 B2 * 2/2015 ..... G01N 21/3504
CN 106194162 A 12/2016
CN 113586036 A 11/2021
(Continued)

OTHER PUBLICATIONS

International Search Report & Written Opinion; PCT Application No. PCT/US2022/053124; mailed Sep. 1, 2023.
(Continued)

*Primary Examiner* — Emerson C Puente
*Assistant Examiner* — Michael Paul Mirabito
(74) *Attorney, Agent, or Firm* — NOVAK DRUCE CARROLL LLP

(57) ABSTRACT

Described herein are systems and techniques for improving operation of equipment that identify compounds included in a slurry that exits a wellbore during a drilling operation. Mass flow rates, volumetric data, wellbore equipment data, and other information may be used to identify a total volumetric density of the slurry. Calculations and/or other evaluations may be performed to identify a volumetric density of materials other than a gas included in the slurry. The volumetric density of the other materials may be subtracted from the total volumetric density to identify a volumetric density of the gas included in the slurry. Estimates of percentages of hydrocarbons and molar mass equations may be used to estimate masses of combined sets of hydrocarbons included in the gas. When a volumetric density of a combined set of hydrocarbons matches the gas volumetric density, the gas may be classified as including the set of hydrocarbons.

20 Claims, 5 Drawing Sheets

(56) References Cited

U.S. PATENT DOCUMENTS

| | | | | |
|---|---|---|---|---|
| 2021/0047911 | A1* | 2/2021 | Rowe | G06T 7/62 |
| 2024/0191610 | A1* | 6/2024 | Albassam | G01N 33/2823 |

FOREIGN PATENT DOCUMENTS

| | | | |
|---|---|---|---|
| EP | 2610427 | B1 | 3/2017 |
| EP | 3577187 | B1 | 1/2022 |
| WO | 2017067641 | A1 | 4/2017 |

OTHER PUBLICATIONS

English abstract of CN113586036; retreived from www.espacenet.com on Sep. 6, 2023.
English abstract of CN106194162; retreived from www.espacenet.com on Sep. 6, 2023.

* cited by examiner

GAS COMPOSITION FROM A DRILLING FLUID DENSITY CHANGE

TECHNICAL FIELD

The present disclosure is generally directed to improving the safety of wellbore operations. More specifically, the present disclosure is directed to detecting hydrocarbon compounds that may be located in drilling fluids that exit a wellbore.

BACKGROUND

When managing oil and gas drilling and production environments (e.g., wellbores, etc.) and performing operations in the oil and gas drilling and production environments, materials that are excavated from the Earth may include hydrocarbons that may pose a fire or explosion risk. When a wellbore is drilled, a drilling fluid provided to lubricate a drill bit that cuts into formations within the Earth. As the drill bit cuts into the Earth, waste materials from the drilling process are forced out of the wellbore as a slurry. This slurry may include the drilling fluid, rocks, hydrocarbons, water, and other materials. During this process, quantities of specific hydrocarbons may seep out of the slurry and pose risks (e.g., fire risk, explosion risk, or other risks) to operators of the wellbore. What are needed are new methods and systems that mitigate such risks efficiently and effectively.

BRIEF DESCRIPTION OF THE DRAWINGS

In order to describe the manner in which the features and advantages of this disclosure can be obtained, a more particular description is provided with reference to specific implementations thereof which are illustrated in the appended drawings. Understanding that these drawings depict only exemplary implementations of the disclosure and are not therefore to be considered to be limiting of its scope, the principles herein are described and explained with additional specificity and detail through the use of the accompanying drawings in which.

DETAILED DESCRIPTION

Figure 1A:
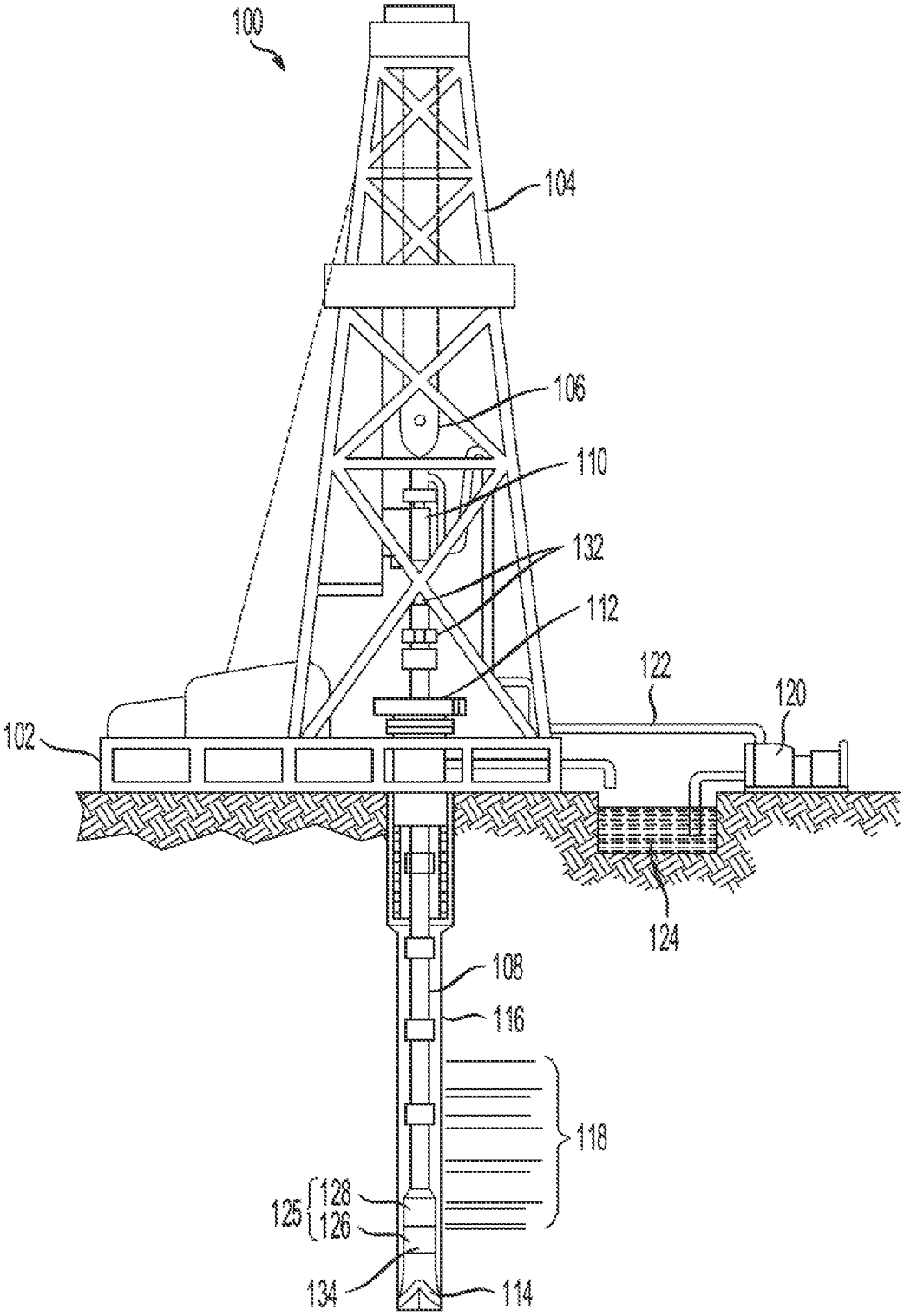
FIG. 1A is a schematic diagram of an example logging while drilling wellbore operating environment, in accordance with various aspects of the subject technology.

Various aspects of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It will be appreciated that for simplicity and clarity of illustration, where appropriate, reference numerals have been repeated among the different figures to indicate corresponding or analogous compounds. In addition, numerous specific details are set forth in order to provide a thorough understanding of the methods and apparatus described herein. However, it will be understood by those of ordinary skill in the art that the methods and apparatus described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the present disclosure.

Described herein are systems, apparatuses, processes (also referred to as methods), and computer-readable media (collectively referred to as "systems and techniques") for improving the safety of operation a wellbore. Such systems and techniques may improve operation of flow meters, lower explosive limit (LEL) gas detectors, devices that identify compositions of materials included in a sample (e.g., gas chromatograph or a high-performance liquid chromatograph), and wellbore operations.

Techniques of the present disclosure may reduce or eliminate the need to move samples of drilling muds from a wellbore drill to a laboratory located away from a drill site. Drilling muds are fluids that may include clay and solids, the drilling mud helps lubricate a drill bit used to drill a wellbore. A flow of drilling mud is provided via an input when that flow is pumped into a wellbore. As the wellbore is being drilled, the drill bit cuts through Earth formations generating waste products that include materials cut out of the Earth formation by the drill bit. The materials cut out of the Earth formation are referred to as cuttings. When a drilling mud is pumped to the drill bit, the mud mixes with cuttings and other materials forming a combined stream that flows back to the surface of the Earth as a waste product. These cuttings and other materials may include rock, sand, salt, water, and hydrocarbons. The presence and concentrations of specific hydrocarbons located with an Earth formation are important to know in order for wellbore operations to continue operating safely. This is because hydrocarbon gasses are explosive, all that is needed for an explosion or a fire to be ignited is enough of a concentration (e.g., a threshold concentration) of a hydrocarbon gas (e.g., methane) and a spark. Safety concerns may also include well operators breathing in gasses that could potentially affect their health. Since used drilling muds that have exited the wellbore may outgas hydrocarbon gasses and since hydrocarbon gasses can affect safety, it is important to monitor compositions and/or concentrations of specific types of hydrocarbons located with a slurry that includes used drilling mud.

Systems and techniques of the present disclosure improve operation of flow meters because flow meters have no means for detecting types of materials that flow through the flow meter. Wellbore operations and the operation of test equipment (e.g., a chromatograph) are improved because wellbore operators may no longer need to move samples of used drilling mud to a remote laboratory environment where equipment (e.g., the chromatograph) used to test the sample for concentrations of hydrocarbons is located—this may help avoid operational delays. Operations of LEL detection devices are improved because such systems and techniques may identify that used drilling muds include greater than a threshold level of hydrocarbons before those gasses can be detected by an LEL detection device. This is because LEL detection devices cannot detect gasses that have not yet been outgassed from a used drilling mud. Methods and apparatus of the present disclosure improve wellbore safety because they provide a means to identify quantities and types of hydrocarbons present in a slurry of wellbore waste materials (e.g., use drilling muds) before significant quantities (above a threshold level or concentration) of hydrocarbon gasses outgas from the slurry of materials. Wellbore safety is also improved because operators may no longer have to wait for test results from a remotely located lab.

Metrics such as mass flow rates, volumetric data, wellbore equipment data, and other information may be used to identify a total volumetric density of the slurry of wellbore waste materials. Calculations and/or other evaluations may be performed to identify a volumetric density of materials other than a gas that may be included in the slurry. The volumetric density of the other materials may be subtracted from the total volumetric density to identify a volumetric density of the gas included in the slurry. Estimates of percentages of hydrocarbons and molar mass equations may be used to estimate masses of combined sets of hydrocarbons included in the slurry. When a volumetric density of a combined set of hydrocarbons matches the gas volumetric density, the gas may be classified as including the combined set of hydrocarbons.

Such hydrocarbons include compounds that contain one or more carbon atoms bound to a set of hydrogen atoms. Molecular formulas for hydrocarbons include the letter C followed by a number and the letter H followed by a number. The number that follows the C and the number that follows the H respectively identify a number of carbon atoms and a number of hydrogen atoms that form a molecule of a specific hydrocarbon. For example, n-Hexane includes six carbon atoms and fourteen hydrogen atoms, because of this, the molecular formula identifying n-Hexane is C6H14. In instances when a particular molecular formula includes only one carbon atom, the resulting molecular formula will include the letter C with no number following the C. For example, Methane has a molecular formula of CH4 because it has one carbon atom and four hydrogen atoms. Some exemplary hydrocarbons and their respective molecular formulas include Methane (CH4), Ethane (C2H6), Propane (C3H8), Pentane (C5H12), n-Hexane (C6H14), Benzene (C6H6), n-Heptane (C7H16), and Octane (C8H18).

Hydrocarbons included in wellbore cuttings be of different types such as Methane (CH4), Ethane (C2H6), Propane (C3H8), Pentane (C5H12), n-Hexane (C6H14), Benzene (C6H6), n-Heptane (C7H16), and Octane (C8H18) mentioned above. Depending on temperatures and pressures that a given compound is exposed to determines whether that given compound is in a gaseous state or a liquid state. For example, n-Hexane is in a liquid state at room temperature (e.g., 25 degrees Celsius) and pressure (e.g. atmospheric pressure of about 14.696 pounds per square inch), where Methane is in a gaseous state at room temperature and pressure. Since n-Hexane has a vaporization temperature at atmospheric pressure of 69 degrees Celsius (C), at atmospheric pressure and at a temperature of 69 C n-Hexane will evaporate.

A volume of a particular compound may also vary depending on a mass of the compound, a temperature of the compound, and a pressure that the compound is exposed to. A hydrocarbon that is in a gaseous state at a given temperature and pressure may be converted into a liquid at the same temperature when exposed to a higher pressure. A pressure and volume of a given compound in a gaseous state may vary according to the ideal gas law. The ideal gas law states that the product of a pressure (P) and volume (V) of an ideal gas are related to the product of a number of moles (n) of the gas, a constant (R), and the temperature (T) of the gas: or PV=nRT. Here the number of moles represent a quantity or number of molecules of the gas. According to the ideal gas law, a volume of this gas at a particular pressure and temperature may be identified by performing the equation V=(nRT)/P. The more moles of a gas that are present at a given temperature and pressure the more volume that gas has. When the number of moles of a particular gas increase, a mass of that gas that is present also increases. Because of this, a volume of a combination of different types of gasses, will have a combined volume that vary with pressure and temperature. A series of equations may be used along with other factors to identify densities of specific types of gasses included in a stream of materials exiting a wellbore.

When a drilling operation uses a drilling mud that includes clay, other solids, and possibly fluids (e.g., water, oil, or a chemical)—that drilling mud has a density that corresponds to fractions or portions of clay, other solids, and possibly the fluids included in a volume of the drilling mud. In certain instances, such fractions may be measured as a percentage of total volume of the drilling mud. For example, by volume, a drilling mud provided to a wellbore may include 70% clay, 25% solids, and 5% water. Because of this, the drilling mud provided to the wellbore will include a mass of clay, a mass of solids, and a mass of water that corresponds to a volumetric density of each of the materials present in the drilling mud. The drilling mud provided to a wellbore may be referred to as a "new," "clean," or "initial" drilling mud fluid that includes an "initial composition" of the drilling mud.

Volumetric density for a given material is a mass per-unit-volume of that material. The mass of each of a set of materials included in a sample of a drilling mud provided to a wellbore may be calculated by multiplying a volume of the material by the volumetric density of the material. In an instance when a total volume of the sample is one Liter and when that material includes 75% clay, 25% solids, and 5% water, masses of these materials may be calculated based on respective volumes and volumetric densities (e.g., grams or Kilograms per Liter). In this instance a formula used to calculate the mass of a Liter of this sample using Formula 1 below. Here the term Tin-mass is a total mass of a Liter of the sample, Cmass/L is the mass of a one Liter volume of the clay, Smass/L is the mass of a one Liter volume of the solids, and Wmass/L is the mass of a one Liter volume of the water.

$$Tin\text{-}mass=0.75*(Cmass/L)+0.25*(Smass/L)+0.05(Wmass/L)$$

Formula 1: Total Mass of a Drilling Mud Provided to a Wellbore $$Pmudin=[(\Phi Cin)*PC]+[(\Phi Sin)*PS]+[(1-\Phi Cin-\Phi Sin)*Pfluid$$

Formula 1A: Density Equation of the Drilling Mud Provided to the Wellbore

Densities of materials included in an initial drilling mud may be calculated using Formula 1A shown above. Formula 1A illustrates that a density of the initial composition of the drilling mud Pmudin may include various factors, where ΦCin is a first metric associated with the fraction of the clay included in the drilling mud, ΦSin is the second metric associated with the fraction of solid included in the drilling mud, PC is a volumetric density of the clay, PS is a volumetric density of the solid, and Pfluid is a volumetric density of a fluid included in the initial composition of the drilling mud.

When the drilling mud is provided to the drill bit that is drilling the wellbore, the drilling mud will combine with materials in the wellbore that have been disturbed by action of the drill bit. Such disturbed materials may be referred to as cuttings and may include rock, sand, hydrocarbons, and possibly additional water or other materials. Because of this, the drilling mud that exits the wellbore will have a density that is different from the density of the drilling mud that was provided to the wellbore.

Techniques of the present disclosure may use mass flow meters to identify the density of the "clean," "new", or "initial" drilling mud provided to a wellbore and to identify the density of a "used" or "dirty" drilling mud that exits the wellbore. The "used" or "dirty" drilling mud that exits the wellbore may be referred to as a "changed composition" of the drilling mud because it contains materials that were cut from an Earth formation where the wellbore is drilled. Such changed compositions or used drilling muds may include materials from the original drilling mud composition as well as rock and hydrocarbons removed from the Earth formation.

The composition of drilling mud provided to the wellbore may already be known because it is a material that is purchased or manufactured for drilling. A flow meter may be used to identify a mass flow rate from which a volumetric flow rate may be determined. Alternatively, or additionally, a flow meter may directly measure a volume and/or mass flowing through the meter. Both volumetric flow rates and mass flow rates may be directly or indirectly determined using a flow meter.

Specifications of a drilling mud or a laboratory analysis representing a manufactured lot of the drilling mud may be referenced with calibrating a mass flow meter. Systems of the present disclosure may use one or more mass flow meters. One mass flow meter may monitor the initial drilling mud that is provided to the wellbore and a second mass flow meter may be used to monitor the used or used drilling mud as it returns from the wellbore. In an instance when the drilling mud provided to the wellbore (new drilling mud) includes a first fraction of clay and a second fraction of solids, those fractions may correspond to volumetric percentages. A total mass of a unit-volume (e.g., a Liter) of the new drilling mud will be a function of the specific density and volumetric percentage of each respective material included in the new drilling mud. This total mass could be calculated using a formula similar to Formula 1 or Formula 1A, reviewed above.

Since the used drilling mud that returns from the wellbore includes the clay and solids from the drilling mud provided to the wellbore (new drilling mud) and includes materials/cuttings disturbed by the drill, the used drilling mud may include clay, solids, rocks, and hydrocarbons. The flow meter used to monitor the used drilling mud may identify a volumetric flow rate and/or mass flow rate of the used drilling mud. In an instance when the mass flow rate of the used drilling mud is 1 thousand grams (Kg) per second and the volumetric flow rate is one Liter per second, one Liter of the used drilling mud will have a mass of 1 Kg. Given conditions of the wellbore environment, all of most of the mud provided to the wellbore will be returned to the surface with cuttings. This may occur because the drilling mud may have no other place to go besides being forced back to the surface. Because of this, masses of the clay and solids included in the initial drilling mud provided to the wellbore per-unit-time should equal masses of the clay and solids that exit the wellbore per-unit-time. Because of differences in densities, a total mass flowing into the wellbore per-unit-time may be different than a total mass flowing out of the wellbore per-unit-time. In such an instance, a total mass flowing out of the wellbore (Tout-mass) would equal a total mass flowing into the wellbore (Tin-mass) plus a cutting mass (Cmass). This may be expressed as shown in Formula 2:

$$Tout\text{-}mass = Tinmass + Cmass$$ Formula 2: Total Mass of a Used Drilling Mud Flowing out of a Wellbore $$Pmudf = [\Phi Cf * PC] + [\Phi Sf * PS] + [\Phi * PK] + [(1 - \Phi Cf - \Phi Sf - \Phi kf) * Pfluidf],$$ Formula 2A: Density Equation of the Used Drilling Mud Flowing out of the Wellbore An alternate form of Formula 2 may be expressed as Formula 2A, where ΦCf is a fraction of the clay included in the used drilling mud (e.g., a changed composition of the initial drilling mud), ΦSf is a fraction of the solid included in the changed composition, Φkf is a fraction of drill cuttings included in the changed composition (where the drill cuttings include a rock mass), PK is a volumetric density of the drill cuttings included in the changed composition, and Pfluidf is a volumetric density of a fluid included in the changed composition.

Since the cutting mass includes a mass of rock and a mass of hydrocarbons, identifying the mass of the rock per-unit-time may need to be determined or estimated in order to determine or estimate a mass of the hydrocarbons per-unit-time being output from the wellbore. Techniques of the present disclosure may identify a mass of the rock and/or a specific gravity of the rock using various techniques. This may include collecting images of the rocks output from the wellbore and using machine vision to identify types of rock and rock volumes.

Alternatively, or additionally, data received from downhole tools may be used to identify bulk density of the rock. This bulk density may be identified from acoustic or electromagnetic data collected from the wellbore that may be analyzed. In an example, the bulk density of rock may be identified by analyzing downhole tool measurements and a volume of rock output from the wellbore per-unit-time may be identified by calculating a volume of rock drilled per-unit-time. The volume of rock exiting the wellbore in the used drilling mud may also be estimated using machine vision. Formula 3 illustrates an equation that may be used to identify the volume of rock drilled per-unit-time.

$$V = (\text{Drill Bit Area/Size}) * (\text{Penetration Rate}) * (\Delta\ \text{Time})$$ Formula 3: Volume of Rock Drilled Per-Unit-Time Formula 3 is an equation used to identify a volume that is drilled over a period of time (A Time). Here, the volume drilled (V) equals a drill bit size times a penetration rate (drilling distance over a time span—e.g., Delta (Δ) Time) times the time span (Δ Time). A drilled volume over a span of 10 seconds, for example for drill bit that has a diameter of 10 centimeters (cm) and a penetration rate of 1 cm per second may be calculated using Formula 3. Since the drill bit has a diameter of 10 cm (a radius of 5 cm), the effective size (or area) of the drill bit is equal to the number π (Pi) times 5 cm squared=78.54 square cm. Since the penetration rate is 1 cm per second and the delta time equals 10 seconds, the volume drilled may be calculated: V=78.54 square cm*1 cm/sec*10 sec=785.4 cubic centimeters. In such an instance, the penetration rate may be measured by measuring how fast a drill shaft moves down the wellbore over the 10 seconds.

Formula 3A may be used to calculate the density of drill cuttings (PCut) cut per-unit-time.

*P*Cut=(the specific gravity of the rock)*(density of water)*[(a measured volume of the rock)/(a drilled volume per-unit-time)]. Formula 3A: Cuttings Density Equation By identifying the density of rock of a particular area and by measuring penetration rates of a known drill size over time, a volumetric density of rock drilled during that time may be identified. This information alone may provide enough information to calculate a volume of rock included in a flow output from the wellbore. While this may be true, images of rocks exiting the wellbore may be used to identify or estimate volumes of the rock and potentially masses of the rock drilled over a time period. Because of this, volumes and densities of rock drilled may be identified using one of these methods or a combination of these methods.

When a volume of clay and solids output from the wellbore equal the volume of clay and solids input to the wellbore over the time period, and when the volumetric density of rock drilled over the time period is identified, a mass of the hydrocarbons included in the flow of used mud out of the wellbore may then be identified. Data from the flow meter monitoring the output of the wellbore may identify a volume and/or a mass of the used drilling mud. The mass output from the wellbore includes a mass of clay, a mass of solids, a mass of rock, and a mass of hydrocarbons. When the volume and total mass output from the wellbore have been identified, when the input volume mass of clay and solids equals the volume and mass of clay and solids output from the wellbore, and when the volume and mass of the rock has been identified or estimated, the mass per-unit-volume (UV) of the hydrocarbons may be identified using Formula 4.

(Hydrocarbon Mass)/UV=(Total Output Mass/UV)−(Clay Mass/UV)−(Solids Mass/UV)−(Rock Mass/UV) Formula 4: Hydrocarbon Mass Calculation Using formula 4, a volumetric mass per-unit-volume of hydrocarbons included in the drilling mud output from the wellbore may be identified. The hydrocarbons included in the used drilling mud may include different gasses with different respective volumes given temperatures and pressures that the used drilling mud and the hydrocarbons are exposed to.

Once a total mass of hydrocarbons is identified, evaluations may be performed that predict or estimate masses and/or volumes of specific gas compounds are included in the used drilling mud. In an instance when hydrocarbons included in a unit-volume of used drilling mud (e.g., 1 Liter of used drilling mud) include 1 gram (g) of hydrocarbons distributed in a volume of 1 Liter (L) of the used drilling mud, an evaluation may be performed to estimate or predict masses of specific hydrocarbons that are included in the Liter of the used drilling mud. In this instance, the volumetric density of the combined hydrocarbons in the used drilling mud is (1 g)/(1 L).

A change in fluid density (ΔPfluid) may also be calculated according to Formula 5, where Pfluidf is the is a volumetric density of a changed fluid included in the changed composition, Pmudin is the density of the initial composition of the drilling mud Φkf is a fraction of drill cuttings included in the changed composition, and PK is a volumetric density of the drill cuttings included in the used drilling mud/changed composition that exits the wellbore.

Δ*P*fluid=*P*fluid*f*−*P*mudin−[Φ*kf***PK*] Formula 5: Change in Fluid Density Equation Formula 6 shows a relationship between the change in fluid density (ΔPfluid), fractions of gas concentrations, and gas densities. Additionally, or alternatively, Formula 6 may be used to estimate fractions of gas compositions included in a used drilling mud. In certain instances, the use of Formula 6 may be used when the summation of the fractional concentrations of the gasses equal one: (e.g., Σ(the fraction concentration of the gasses)=1), and when the fraction of gasses is greater than or equal to zero and is less than or equal to 1: (e.g., 0≤the fraction of the gasses≤1).

Δ*P*fluid=Σ[(a fraction concentration of the gasses)*(gas density)] Formula 6: Fraction of Gas Composition Equation Formula 6 may be used to evaluate gasses of methane through pentane, a concentration of one gas (e.g., Methane) may be divided by a sum of concentrations of other gasses (e.g. Methane through Pentane). Such concentrations may be measured in units of a volumetric measure, for example in parts-per-million per-meter (ppm-m).

FIG. 1A is a schematic diagram of an example logging while drilling wellbore operating environment, in accordance with various aspects of the subject technology. The drilling arrangement shown in FIG. 1A provides an example of a logging-while-drilling (commonly abbreviated as LWD) configuration in a wellbore drilling scenario 100. The LWD configuration can incorporate sensors (e.g., EM sensors, seismic sensors, gravity sensor, image sensors, etc.) that can acquire formation data, such as characteristics of the formation, components of the formation, etc. For example, the drilling arrangement shown in FIG. 1A can be used to gather formation data through an electromagnetic imager tool (not shown) as part of logging the wellbore using the electromagnetic imager tool. The drilling arrangement of FIG. 1A also exemplifies what is referred to as Measurement While Drilling (commonly abbreviated as MWD) which utilizes sensors to acquire data from which the wellbore's path and position in three-dimensional space can be determined. FIG. 1A shows a drilling platform 102 equipped with a derrick 104 that supports a hoist 106 for raising and lowering a drill string 108. The hoist 106 suspends a top drive 110 suitable for rotating and lowering the drill string 108 through a well head 112. A drill bit 114 can be connected to the lower end of the drill string 108. As the drill bit 114 rotates, it creates a wellbore 116 that passes through various subterranean formations 118. A pump 120 circulates drilling fluid through a supply pipe 122 to top drive 110, down through the interior of drill string 108 and out orifices in drill bit 114 into the wellbore. The drilling fluid returns to the surface via the annulus around drill string 108, and into a retention pit 124. The drilling fluid transports cuttings from the wellbore 116 into the retention pit 124 and the drilling fluid's presence in the annulus aids in maintaining the integrity of the wellbore 116. Various materials can be used for drilling fluid, including oil-based fluids and water-based fluids.

Logging tools 126 can be integrated into the bottom-hole assembly 125 near the drill bit 114. As drill bit 114 extends into the wellbore 116 through the formations 118 and as the drill string 108 is pulled out of the wellbore 116, logging tools 126 collect measurements relating to various formation properties as well as the orientation of the tool and various other drilling conditions. The logging tool 126 can be applicable tools for collecting measurements in a drilling scenario, such as the electromagnetic imager tools described herein. Each of the logging tools 126 may include one or more tool components spaced apart from each other and communicatively coupled by one or more wires and/or other communication arrangement. The logging tools 126 may also include one or more computing devices communicatively coupled with one or more of the tool components. The one or more computing devices may be configured to control or monitor a performance of the tool, process logging data, and/or carry out one or more aspects of the methods and processes of the present disclosure.

The bottom-hole assembly 125 may also include a telemetry sub 128 to transfer measurement data to a surface receiver 132 and to receive commands from the surface. In at least some cases, the telemetry sub 128 communicates with a surface receiver 132 by wireless signal transmission (e.g., using mud pulse telemetry, EM telemetry, or acoustic telemetry). In other cases, one or more of the logging tools 126 may communicate with a surface receiver 132 by a wire, such as wired drill pipe. In some instances, the telemetry sub 128 does not communicate with the surface, but rather stores logging data for later retrieval at the surface when the logging assembly is recovered. In at least some cases, one or more of the logging tools 126 may receive electrical power from a wire that extends to the surface, including wires extending through a wired drill pipe. In other cases, power is provided from one or more batteries or via power generated downhole.

Collar 134 is a frequent component of a drill string 108 and generally resembles a very thick-walled cylindrical pipe, typically with threaded ends and a hollow core for the conveyance of drilling fluid. Multiple collars 134 can be included in the drill string 108 and are constructed and intended to be heavy to apply weight on the drill bit 114 to assist the drilling process. Because of the thickness of the collar's wall, pocket-type cutouts or other type recesses can be provided into the collar's wall without negatively impacting the integrity (strength, rigidity and the like) of the collar as a component of the drill string 108.

Figure 1B:
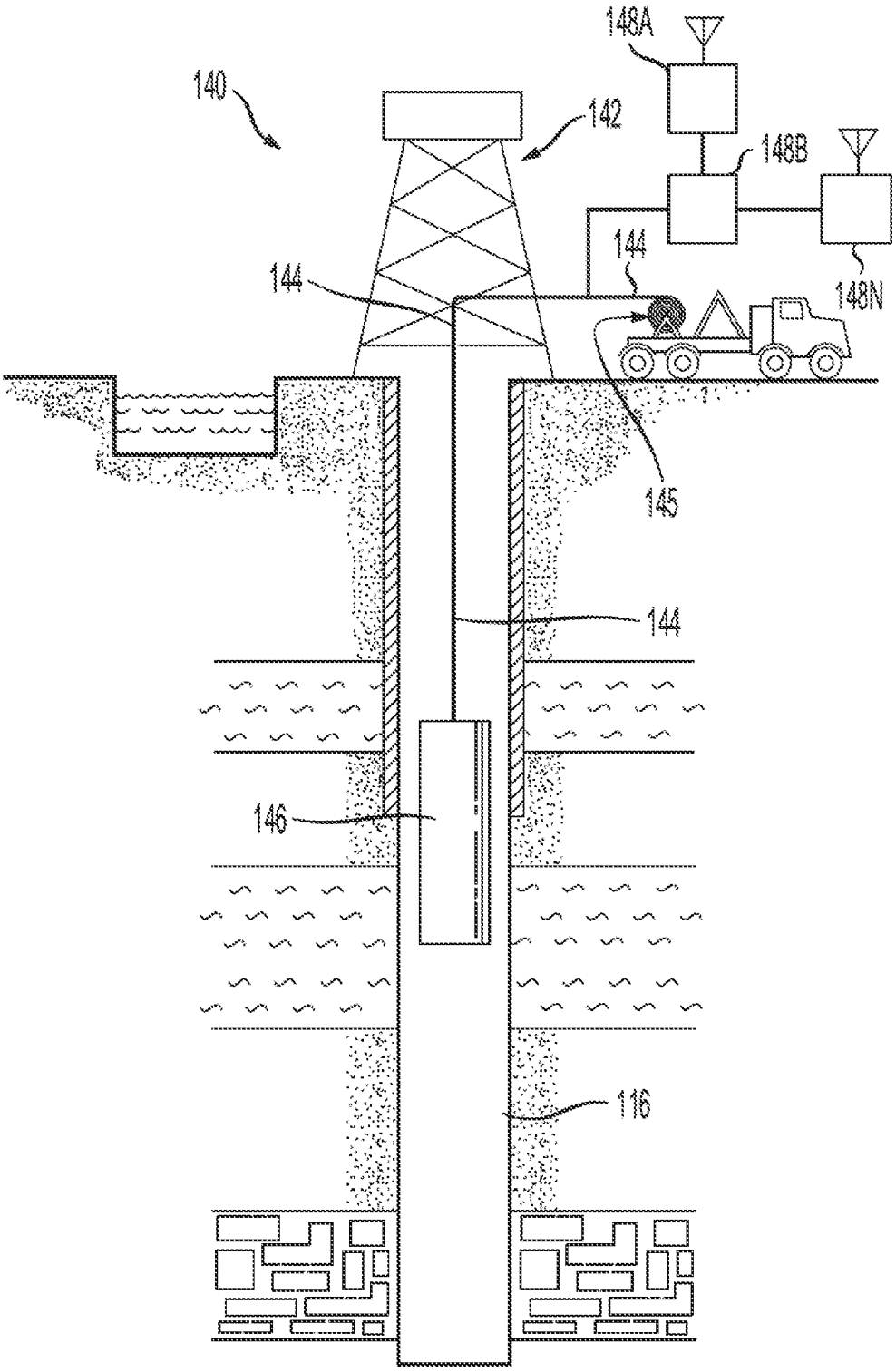
FIG. 1B is a schematic diagram of an example downhole environment having tubulars, in accordance with various aspects of the subject technology.

FIG. 1B is a schematic diagram of an example downhole environment having tubulars, in accordance with various aspects of the subject technology. In this example, an example system 140 is depicted for conducting downhole measurements after at least a portion of a wellbore has been drilled and the drill string removed from the well. An electromagnetic imager tool (not shown) can be operated in the example system 140 shown in FIG. 1B to log the wellbore. A downhole tool is shown having a tool body 146 in order to carry out logging and/or other operations. For example, instead of using the drill string 108 of FIG. 1A to lower the downhole tool, which can contain sensors and/or other instrumentation for detecting and logging nearby characteristics and conditions of the wellbore 116 and surrounding formations, a wireline conveyance 144 can be used. The tool body 146 can be lowered into the wellbore 116 by wireline conveyance 144. The wireline conveyance 144 can be anchored in the drill rig 142 or by a portable means such as a truck 145. The wireline conveyance 144 can include one or more wires, slicklines, cables, and/or the like, as well as tubular conveyances such as coiled tubing, joint tubing, or other tubulars. The downhole tool can include an applicable tool for collecting measurements in a drilling scenario, such as the electromagnetic imager tools described herein.

The illustrated wireline conveyance 144 provides power and support for the tool, as well as enabling communication between data processors 148A-N on the surface. In some examples, the wireline conveyance 144 can include electrical and/or fiber optic cabling for carrying out communications. The wireline conveyance 144 is sufficiently strong and flexible to tether the tool body 146 through the wellbore 116, while also permitting communication through the wireline conveyance 144 to one or more of the processors 148A-N, which can include local and/or remote processors. The processors 148A-N can be integrated as part of an applicable computing system, such as the computing device architectures described herein. Moreover, power can be supplied via the wireline conveyance 144 to meet power requirements of the tool. For slickline or coiled tubing configurations, power can be supplied downhole with a battery or via a downhole generator.

Figure 2:
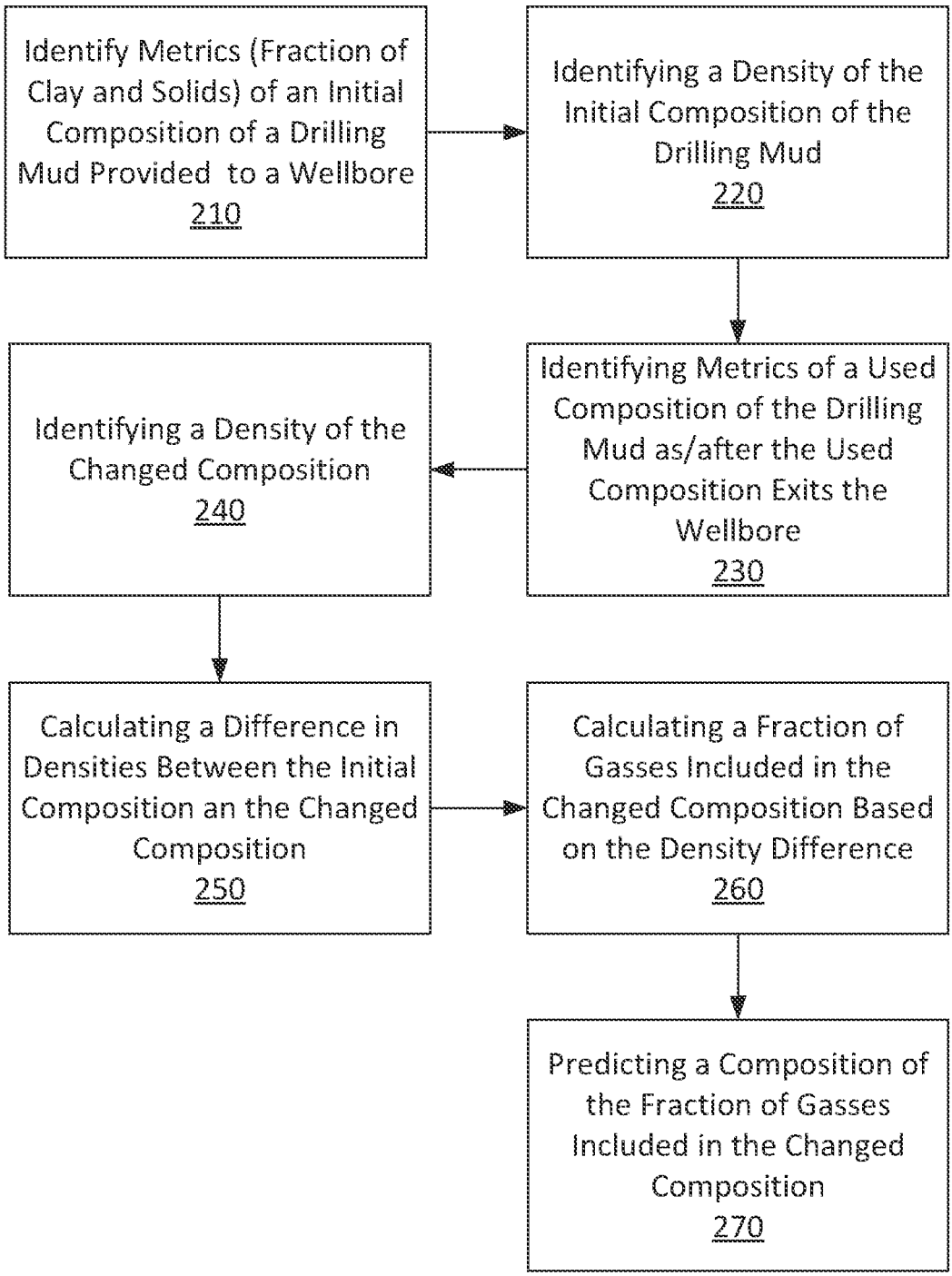
FIG. 2 illustrates an example process for predicting specific compounds that may be included in a flow of materials that exit a wellbore during a drilling operation, in accordance with various aspects of the subject technology.

FIG. 2 illustrates an example process for predicting specific compounds that may be included in a flow of materials that exit a wellbore during a drilling operation. Drilling muds provided to a wellbore may be used to lubricate a drill bit that drills the wellbore. The drilling mud provided to the wellbore may be referred to as a "new" drilling mud," a "clean" drilling mud, or an "initial" drilling mud that has an "initial composition" because this drilling mud may have been newly manufactured or purchased such that the drilling mud is free of contaminates that are located within an Earth formation. Such an "initial" drilling mud may include known percentages of different materials per-unit-volume of the new drilling mud. For example, this new drilling mud may include 70% clay and 30% solids by volume. In this instance, a fraction of clay included in the new drilling mud is 70% and a fraction of solids in this new drilling mud is 30%. These fractions of the initial drilling mud may be referred to as metrics of an initial drilling mud that are provided to the wellbore at block 210 of FIG. 2. Volumetric densities of this clay and solids may be used to identify masses per-unit-volume of clay and solids included in the new drilling mud using computations similar to those discussed in respect to Formula 1 and Formula 1A above. The composition of a new drilling mud may be known or be identified via various means. For example, the composition of the new drilling mud may be specified, or the new drilling mud may be tested with various types of equipment to identify the composition. As such the fractions identified at block 210 of FIG. 2 may be percentages of clay and solids that are included in a unit-volume of the initial drilling mud. At block 220 densities of materials included in the initial drilling mud (e.g., densities of clay and solids) may be identified. These densities may be identified based on product specifications or direct measurements. In certain instances, densities of the materials included in a drilling mud may vary with temperature or pressure and in such instances, temperature and or pressure measurements may be used to determine a current density of these materials given current temperature or pressure conditions. Calculations may be performed at block 220 may identify the density of the initial drilling mud composition. Drilling muds provided to a wellbore may be referred to as a slurry of drilling mud or as a drilling mud fluid.

In certain instances, a flow meter may monitor the flow of initial drilling mud into the wellbore. Such a flow meter may be a mass flow meter may be of any type of mass flow meter, including yet not limited to a Coriolis flow meter. A measured flow rate may be used to identify a volumetric flow rate associated with the flow of the initial drilling mud into the wellbore. A flow of this initial drilling mud may be provided to a wellbore when a drilling operation is performed at an input flow rate. In instances when the drilling mud provided to the wellbore does not seep into Earth formations, most or all of the drilling mud provided to the input of the wellbore will exit the wellbore at a rate that equals the input flow rate. Since, the drilling mud picks up pieces of an Earth formation (e.g., rock and hydrocarbons) that is being drilled into, a used drilling mud that that flows out of the wellbore will include the clay and solids of the initial drilling mud and will include the rock and hydrocarbons drilled out of the Earth formation. This used drilling mud may be referred to as a changed composition that includes a fraction of gasses and an estimated mass of rock or other materials that were drilled out of the Earth formation.

At block 230 metrics of the used composition that exits the wellbore may be identified. This may include a number of operations not illustrated in FIG. 2. For example, a second flow meter may be used to identify a mass flow rate exiting the wellbore. These metrics may be identified using data from the mass flow meter, measurements that identify a total volume of materials exiting the wellbore per-unit-time, estimated masses and specific gravity of rocks exiting the wellbore, and other measurements or calculations. Calculations like those discussed in respect to Formula 2A may be used to identify the density of the changed composition (used drilling mud), and this changed composition may include a fraction of gasses and a fraction of estimated rock mass. These fractions may be expressed as percentages of a volumetric flow rate of the used drilling mud Since the used drilling mud that returns from the wellbore includes the clay and solids from the drilling mud provided to the wellbore (initial drilling mud) and includes materials/cuttings disturbed by the drill, the used drilling mud may include clay, solids, rocks, and hydrocarbons. The flow meter used to monitor the used drilling mud may identify a volumetric flow rate and/or mass flow rate of the used drilling mud. In an instance when the mass flow rate of the used drilling mud is 1 thousand grams (Kg) per second and the volumetric flow rate is one Liter per second, one Liter of the used drilling mud will have a mass of 1 Kg. Given conditions of the wellbore environment, all of most of the mud provided to the wellbore may be returned to the surface with the cuttings (e.g., rocks) and fractions of hydrocarbons. All or most of the drilling mud provided to the wellbore may exit the wellbore because the drilling mud may have no other place to go besides being forced back to the surface. Because of this, masses of the clay and solids included in the initial drilling mud (initial composition) provided to the wellbore per-unit-time should equal masses of the clay and solids that exit the wellbore per-unit-time in the used drilling mud (the changed composition). Because of differences in densities, a total mass flowing into the wellbore per-unit-time may be different than a total mass flowing out of the wellbore per-unit-time. In such an instance, a total mass flowing out of the wellbore (Tout-mass) would equal a total mass flowing into the wellbore (Tin-mass) plus a cutting mass (Cmass). This may be expressed as shown in Formula 2 discussed above.

Techniques of the present disclosure may identify a mass of the rock and/or a specific gravity of the rock using various techniques. This may include collecting images of the rocks output from the wellbore and using machine vision to identify rock types and rock volumes. Alternatively, or additionally, data received from downhole tools may be used to identify bulk density of the rock. This bulk density may be identified from acoustic or electromagnetic data collected from the wellbore that may be analyzed. In an example, the bulk density of rock may be identified by analyzing downhole tool measurements and a volume of rock output from the wellbore per-unit-time may be identified using machine vision. Calculations may also be performed to identify the volume of rock per-unit-time removed from a wellbore based on Formula 3 discussed above.

A mass flow meter may be used to identify a total mass flowing out of the wellbore per-unit-time. A volume of this mass flow may also be measured or otherwise determined. In an example, when an amount of time it takes to fill a container (or a volume of an output pipe) with a volume of the output flow may be used to calculate a volumetric flow rate. The techniques discussed above may be used to identify a mass and volume of rock that exits the wellbore per-unit-time, and this information may be used to identify a specific gravity (e.g., mass/volume) of the rock. In instances when the input flow of clay and solids included in the initial drilling mud corresponds to an output flow of clay and solids from the wellbore, a volumetric density of the clay and the solids in the output flow may be identified. At block 250, a calculation may be performed that identifies a change in density between the initial composition and the changed composition. This may include identifying a difference between the density of a composition of the used drilling mud (changed composition) and the density of the initial drilling mud composition (initial composition). The change in fluid densities may be calculated using Formula 5.

In an instance when an output flow from a wellbore includes clay, solids, rock, and combined hydrocarbons, the total mass exiting the wellbore may be a summation of the massed of these different materials. Since a mass of the clay, the solids, and the rock per-unit-volume may be identified using the techniques described above, a computation according to Formula 4 may be performed to identify a mass of the combined hydrocarbons included in a unit volume of the changed composition of drilling mud. At block 250, a calculation may be performed that identifies a change in density between the initial composition and the changed composition. Based on this, a fraction of gasses included in the changed composition may be identified/calculated at block 260 based on the density difference identified at block 250. This may include performing a calculation according to Formula 4. Such a fraction of gassed may be expressed a percentage mass attributed to gasses included in a total mass of a used drilling mud. The fractions of gas may be calculated using Formula 6 discussed above.

Next, at block 270 a prediction that identifies fractions of specific gasses that may be included in the changed composition may be performed. In an instance when hydrocarbons included in a unit-volume of used drilling mud include 1.7 grams (g) of hydrocarbons distributed in a volume of 1 Liter (L) of the used drilling mud, an evaluation may be performed to estimate or predict masses of specific hydrocarbons that are included in the 1 Liter of the used drilling mud. In this instance, the volumetric density of the combined hydrocarbons is 1.7 g/L.

Table 1 illustrates different types of hydrocarbon compounds and their respective molecular formulas. Table 1 identifies the molecular formula for several different hydrocarbon compound: Methane ($CH_4$), Ethane ($C_2H_6$), Propane ($C_3H_8$), Pentane ($C_5H_{12}$), n-Hexane ($C_6H_{14}$), Benzene ($C_6H_6$), n-Heptane ($C_7H_{16}$), and Octane ($C_8H_{18}$). Table 1 also identifies a volumetric density in grams mass per Liter (g/L) of these compounds at 25 degrees C. and at atmospheric pressure.

The combined volumetric density of the combined hydrocarbons included in the example mentioned above is (1.7 g)/(1 L). Because of this, masses of specific types of hydrocarbon compounds included in the combined gasses may be estimated based on knowing the volumetric density at the temperature and pressure of the combined gasses.

TABLE 1

Hydrocarbon Compound Type Vs Compound Properties and Metrics

| Compound | Molecular Formula | Volumetric Density at 25 Degrees Celsius at Atmospheric Pressure g/L |
|---|---|---|
| Methane | CH4 | 0.648 |
| Ethane | C2H6 | 1.219 |
| Propane | C3H8 | 1.808 |
| Pentane | C5H12 | 621.1 |
| n-Hexane | C6H14 | 671 |
| Benzene | C6H6 | 873.8 |
| N-Heptane | C7H16 | 679.5 |
| Octane | C8H18 | 698.6 |

This process may include running numerous calculations to see what combinations of calculations best fits the combined gas volumetric density of 1.7 g/L. A careful examination of the data in table 1 would allow some compounds to be eliminated an evaluation. Note that since Pentane, n-Hexane, Benzene, n-Heptane, and Octane have volumetric densities greater than 600 g/L, if these substances are included in the output flow, they must have very low concentrations. This is because 600 g/L is very heavy as compared to the combined gas volumetric density of 1.7 g/L in this example. Since, Methane, Ethan, and Propane have a volumetric density less than 2 grams per Liter, the output flow may likely include Methane, Ethan, and/or Propane. Since the volumetric density of Methane is significantly smaller than the volumetric density of Ethane, Propane, and the combined gas, it may be less likely that the output flow includes significant Methane. This is because at the pressure and temperature of this example (25 C and atmospheric pressure) Methane has a volumetric density of 0.648 g/L and 1.7 grams of Methane would have a volume of 2.62 Liters (1.7/0.648=2.62). This is much larger than 1 Liter and because of this, the combined gas is unlikely to include much Methane. By eliminating compounds that could only be present at very small concentrations, estimates of substances that are likely to be present in an output flow may be made more quickly.

At this point estimates of volumetric percentages of specific gasses could be selected and a related combined volumetric density could be calculated to see if this estimate corresponds to the previously determined volumetric density of the combined gas. When an estimate of volumetric percentages of the combined gas includes 80% Propane and 20% Ethane, equations could be used to identify a resulting volumetric density of such a set of combined gasses. Since the volume the combined gas is measured in grams per Liter, this would result in: (0.8*1.808)+(0.2*1.219)=1.6902 grams. This result is very close to the 1.7 g/L of the hydrocarbon concentrations included in the output from the wellbore, because of this it may be determined that the primary hydrocarbons included in these output materials are Propane and Ethane.

The result reviewed above may have been determined after making calculations that were based on other possible combinations of gasses. For example, if another possible combination included 50% Propane, 40% Ethane, and 10% Methane, the resulting mass would be: (0.5*1.808)+(0.4*1.219)+(0.1*0.648)=1.4564 grams. Another possible combination could be 60% Propane and 35% Ethane, and 5% Methane, resulting in: (0.6*1.808)+(0.35*1.219)+(0.05*0.648)=1.54385 grams. Yet another possible combination could be 65% Propane, 30% Ethane, and 5% Methane, the resulting mass would be: (0.65*1.808)+(0.3*1.219)+(0.05*0.648)=1.5733 grams.

The different results evaluated above may be evaluated to see if each resulting gram weight of each respective predicted combined gas composition is within a threshold percentage or value of the 1.7 grams per Liter. The various masses that correspond to the different estimates reviewed above are 1.4564 grams, 1.54385 grams, 1.5733 grams, and 1.6902 grams. Respectively, each of these gram weights are within 14.3%, 9.1%, 7.5%, and 0.47% respectively of the 1.7 g/Liter. In an instance when a threshold percentage difference between a measured mass and a mass estimate is set at a value less than 7.5%, the estimated volumetric distribution (80% Propane and 20% Ethane) associated with the 1.6902 gram weight may be selected. This means that a regression analysis that compares gram weights of a plurality of different estimated compound distributions to a determined gram weight may select an estimated compound distribution from a plurality of estimated compound distributions based on a gram weight being within a threshold value of the determined gram weight.

While not illustrated in FIG. 2, a concentration of gasses per unit volume of the used drilling mud may be used to identify a fire or explosion risk and when fractions of gasses included in the changed composition reach or approach a threshold level, a warning (alarm sounding or electronic messages being sent) message may be issued (e.g., a computer initiated alarm being sounded/illuminated or electronic messages being sent), or a corrective action may be initiated. Corrective actions may include automatically pausing drilling operations, slowing drilling, and/or initiating other gas mitigation techniques.

Figure 3:
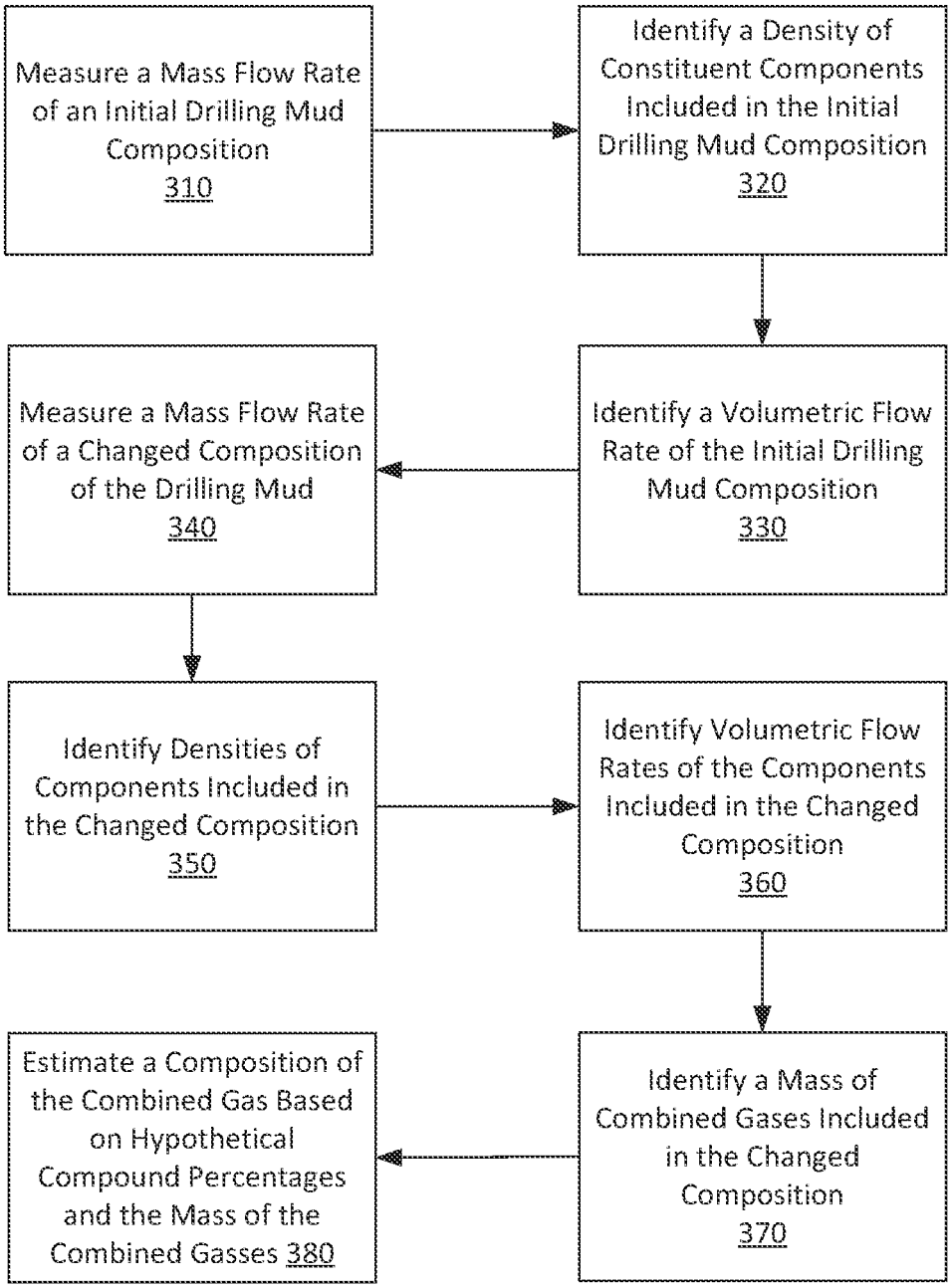
FIG. 3 illustrates a flowchart of an example process for identifying combinations of gasses that may be included in materials flowing out of a wellbore when a drilling operation is performed, in accordance with various aspects of the subject technology.

FIG. 3 illustrates a flowchart of an example process for identifying combinations of gasses that may be included in materials flowing out of a wellbore when a drilling operation is performed. At block 310 a measure of a mass flow rate of a new or initial drilling mud may be identified. As discussed above this mass flow rate may be identified using a mass flow meter. A density of constituent components included in this initial drilling mud may be identified at block 320. This may include a processor executing instructions out of a memory to access data stored at a database or at the memory that identifies volumetric densities of materials included in the initial drilling mud. As such this processor may perform calculations using any of the formulas discussed above.

As discussed above, volumetric densities of the initial drilling mud may be known from a set of specifications or may have been measured by equipment (e.g., a gas chromatograph or high-performance liquid chromatograph) that measures compounds included in a sample of the initial drilling mud. The mass flow rate of this initial drilling mud composition may be monitored as the initial drilling mud is provided to an input at the wellbore.

A volumetric flow rate of the initial drilling mud may be identified at block 330. This volumetric flow rate may be identified from the mass flow rate identified at block 310 and from the densities of constituent components that were identified at block 320. A simple calculation could be used that multiplies a mass per-unit-time of the initial drilling mud times a density of the drilling mud to identify this volumetric flow rate.

As a used drilling mud returns to the surface of the wellbore, a mass flow meter may be used to measure a mass flow rate of a changed composition of the drilling mud at block 340. This changed composition may be a composition of the "used" drilling mud discussed above. Densities of components included in the changed composition may be identified in block 350. As mentioned above, materials that flow out of the wellbore per-unit-time may include the mass of the drilling mud input to the wellbore, a mass of rock, and a mass of combined hydrocarbons. The mass of rock that exits the wellbore may be estimated using machine vision or may be calculated as a function of a volume drilled per-unit-time and a function of rock densities measured using downhole measurement equipment. Once the mass flow rate and the densities flowing out of the wellbore are identified, a volumetric flow rate of the components included in the changed composition may be identified at block 360.

A mass of a combined gas included in the changed composition may be identified at block 370 as discussed in the example above where the volumetric density of a hydrocarbons included in the combined gas have a density of 1.7 g/L. In this example, data from Table 1 was used to identify percentages of specific hydrocarbons that were likely to be included in the combined gas that has the density of 1.7 g/L. An estimate of a composition of the combined gas may be identified by making a series of estimates and evaluations at block 380 of FIG. 3. This may include iteratively identifying percentages of specific hydrocarbon compounds that could be included in the combined gas. Each estimate of a set of estimates could identify a hypothetical set of percentages of specific compounds that could be included in the combined gas. In the example above, hypothetical concentrations of hydrocarbons included 50% Propane, 40% Ethane, and 10% Methane; 60% Propane and 35% Ethane, and 5% Methane; 65% Propane, 30% Ethane, and 5% Methane; and 80% Propane and 20% Ethane. Calculations were then performed to identify total masses of these different hypothetical concentrations that could be included in the one Liter volume. The equations for each of these hypothetical concentrations and resulting masses are:

A 50% Propane, 40% Ethane, and 10% Methane combination that has a resulting mass of: (0.5*1.808)+(0.4*1.219)+(0.1*0.648)=1.4564 grams;

A 60% Propane and 35% Ethane, and 5% Methane combination that has a resulting mass of: (0.6*1.808)+(0.35*1.219)+(0.05*0.648)=1.54385 grams;

A 65% Propane, 30% Ethane, 5% Methane combination that has a resulting mass of: (0.65*1.808)+(0.3*1.219)+(0.05*0.648)=1.5733 grams; and A 80% Propane and 20% Ethane combination that has a resulting mass of: (0.8*1.808)+(0.2*1.219)=1.6902 grams.

Since the 1.6902 combination of 80% Propane and 20% Ethane is very close to the 1.7 g concentration, the combined concentration of hydrocarbons included in a flow of materials may be attributed to the presence of a combined gas that includes 80% Propane and 20% Ethane at block 380 of FIG. 3.

Figure 4:
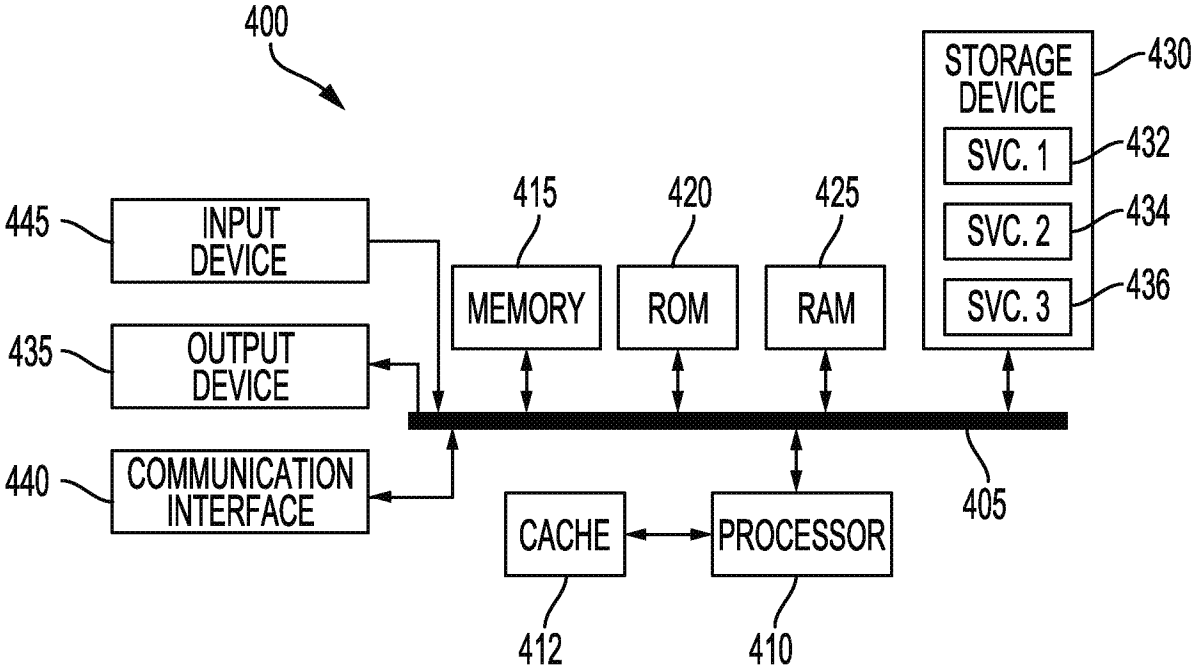
FIG. 4 illustrates an example computing device architecture which can be employed to perform various steps, methods, and techniques disclosed herein.

FIG. 4 illustrates an example computing device architecture 400 which can be employed to perform any of the systems and techniques described herein. In some examples, the computing device architecture can be integrated with the electromagnetic imager tools described herein. Further, the computing device can be configured to implement the techniques of controlling borehole image blending through machine learning described herein.

The components of the computing device architecture 400 are shown in electrical communication with each other using a connection 405, such as a bus. The example computing device architecture 400 includes a processing unit (CPU or processor) 410 and a computing device connection 405 that couples various computing device components including the computing device memory 415, such as read only memory (ROM) 420 and random access memory (RAM) 425, to the processor 410.

The computing device architecture 400 can include a cache of high-speed memory connected directly with, in close proximity to, or integrated as part of the processor 410. The computing device architecture 400 can copy data from the memory 415 and/or the storage device 430 to the cache 412 for quick access by the processor 410. In this way, the cache can provide a performance boost that avoids processor 410 delays while waiting for data. These and other modules can control or be configured to control the processor 410 to perform various actions. Other computing device memory 415 may be available for use as well. The memory 415 can include multiple different types of memory with different performance characteristics. The processor 410 can include any general purpose processor and a hardware or software service, such as service 1 432, service 2 434, and service 3 436 stored in storage device 430, configured to control the processor 410 as well as a special-purpose processor where software instructions are incorporated into the processor design. The processor 410 may be a self-contained system, containing multiple cores or processors, a bus, memory controller, cache, etc. A multi-core processor may be symmetric or asymmetric.

To enable user interaction with the computing device architecture 400, an input device 445 can represent any number of input mechanisms, such as a microphone for speech, a touch-sensitive screen for gesture or graphical input, keyboard, mouse, motion input, speech and so forth. An output device 435 can also be one or more of a number of output mechanisms known to those of skill in the art, such as a display, projector, television, speaker device, etc. In some instances, multimodal computing devices can enable a user to provide multiple types of input to communicate with the computing device architecture 400. The communications interface 440 can generally govern and manage the user input and computing device output. There is no restriction on operating on any particular hardware arrangement and therefore the basic features here may easily be substituted for improved hardware or firmware arrangements as they are developed.

Storage device 430 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 425, read only memory (ROM) 420, and hybrids thereof. The storage device 430 can include services 432, 434, 436 for controlling the processor 410. Other hardware or software modules are contemplated. The storage device 430 can be connected to the computing device connection 405. In one aspect, a hardware module that performs a particular function can include the software component stored in a computer-readable medium in connection with the necessary hardware components, such as the processor 410, connection 405, output device 435, and so forth, to carry out the function.

For clarity of explanation, in some instances the present technology may be presented as including individual functional blocks including functional blocks comprising devices, device components, steps or routines in a method implemented in software, or combinations of hardware and software.

In some instances, the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions and data which cause or otherwise configure a general purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific examples and aspects thereof, but those skilled in the art will recognize that the application is not limited thereto. Thus, while illustrative examples and aspects of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, examples and aspects of the systems and techniques described herein can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate examples, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Methods and apparatus of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Such methods may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Claim language or other language in the disclosure reciting "at least one of" a set and/or "one or more" of a set indicates that one member of the set or multiple members of the set (in any combination) satisfy the claim. For example, claim language reciting "at least one of A and B" or "at least one of A or B" means A, B, or A and B. In another example, claim language reciting "at least one of A, B, and C" or "at least one of A, B, or C" means A, B, C, or A and B, or A and C, or B and C, or A and B and C. The language "at least one of" a set and/or "one or more" of a set does not limit the set to the items listed in the set. For example, claim language reciting "at least one of A and B" or "at least one of A or B" can mean A, B, or A and B, and can additionally include items not listed in the set of A and B.

Illustrative Aspects of the disclosure include:

Aspect 1: A method comprising identifying a set of metrics of an initial composition of a drilling mud provided to a wellbore. This set of metrics may include a first metric associated with a fraction of clay and a second metric associated with a fraction of solid included in the initial composition of the drilling mud provided to the wellbore. The method may also include calculating a density of the initial composition of the drilling mud as a function of the first metric associated with the fraction of the clay and the second metric associated with the fraction of the solid included in the initial composition of the drilling mud, wherein the initial composition of the drilling mud is changed to a changed composition of the drilling mud after the initial composition of the drilling mud is provided to the wellbore, and wherein the changed composition of the drilling mud includes a fraction of gasses and an estimated rock mass. The method may also include calculating a density of the changed composition that includes the fraction of gasses and the estimated rock mass; identifying a density difference by subtracting the density of the changed composition from the density of the initial composition; identifying the fraction of gasses included in the changed composition based on the density difference and the estimated rock mass; and predicting a composition of the fraction of gasses included in the changed composition based on the density difference.

Aspect 2: The method of Aspect 2, further comprising identifying a mass flow rate of the initial composition of the drilling mud provided to the wellbore; and identifying a mass flow rate of the changed composition as the changed composition exits the wellbore.

Aspect 3: The method of any of Aspects 1 or 2, wherein the density of the initial composition of the drilling mud (Pmudin) is calculated by applying an equation of:

$$Pmudin=[(\Phi Cin)*PC]+[(\Phi Sin)*PS]+[(1-\Phi Cin-\Phi Sin)*Pfluid], \text{ where:}$$

ΦCin is the first metric associated with the fraction of the clay included in the initial composition of the drilling mud, ΦSin is the second metric associated with the fraction of solid included in the initial composition of the drilling mud, PC is a volumetric density of the clay, PS is a volumetric density of the solid, and Pfluid is a volumetric density of a fluid included in the initial composition of the drilling mud, wherein the initial composition of the drilling mud is changed to a changed composition after the drilling mud is provided to the wellbore.

Aspect 4: The method of any of Aspects 1 through 3, wherein the density of the changed composition of the drilling mud is calculated by applying an equation of:

$$Pmudf=[\Phi Cf*PC]+[\Phi Sf*PS]+[\Phi kf*PK]+[(1-\Phi Cf-\Phi Sf-\Phi kf)*Pfluidf], \text{ where:}$$

ΦCf is a fraction of the clay included in the changed composition,

ΦSf is a fraction of the solid included in the changed composition,

Φkf is a fraction of drill cuttings included in the changed composition, wherein the drill cuttings include a rock mass, PK is a volumetric density of the drill cuttings included in the changed composition, and Pfluidf is a volumetric density of a fluid included in the changed composition.

Aspect 5: The method of any of Aspects 1 through 4, wherein the first metric corresponds to a volumetric percentage of the clay in the initial composition of the drilling mud, and the second metric corresponds to a volumetric percentage of the solid in the initial composition of the drilling mud.

Aspect 6: The method of method of any of Aspects 1 through 6, further comprising identifying a specific gravity of rock included in the changed composition, the specific gravity of the rock included in the changed composition corresponding to the mass of the rock in a volume of the changed composition.

Aspect 7: The method of method of any of Aspects 1 through 6, wherein the specific gravity of the rock is identified by acquiring an image of the rock included in the changed composition; and performing an evaluation of the image that identifies the specific gravity of the rock by estimating the mass of the rock included in the volume of the changed composition.

Aspect 8: The method of method of any of Aspects 1 through 7, further comprising calculating a density of drill cuttings (PCut), by applying an equation of:

$$P\text{Cut}=(\text{the specific gravity of the rock})*(\text{density of water})*[(\text{a measured volume of the rock})/(\text{a drilled volume per-unit-time})].$$

Aspect 9: The method of method of any of Aspects 1 through 8, further comprising identifying the drilled volume (V) per-unit-time (Δ Time) by applying an equation of:

$$V=(\text{drill bit area})*(\text{penetration rate})*(\Delta\ \text{Time}).$$

Aspect 10: The method of method of any of Aspects 1 through 9, further comprising calculating a change in fluid density (ΔPfluid) by applying an equation of:

$$\Delta P\text{fluid}=P\text{fluid}f-P\text{mudin}-[\Phi kf*PK].$$

Aspect 11: The method of method of any of Aspects 1 through 10, further comprising estimating a fraction of gas compositions included in the changed composition based on a relationship of:

$$\Delta P\text{fluid}=\Sigma[(\text{a fraction concentration of the gasses})*(\text{gas density})],\ \text{when:}$$

$\Sigma$(the fraction concentration of the gasses)=1, and

0≤the fraction of the gasses≤1.

Aspect 12: The method of method of any of Aspects 1 through 11, wherein the mass flow rate of the initial composition of the drilling mud provided to the wellbore is identified based on the initial composition of the drilling mud flowing through a mass flow meter.

Aspect 13: The method of method of any of Aspects 1 through 12, wherein the mass flow rate of the changed composition is identified based at least in part on a portion of the changed composition flowing through the mass flow meter or a second mass flow meter.

Aspect 14: A system comprising a memory; and one or more processors that execute instructions out of the memory to identify a set of metrics of an initial composition of a drilling mud provided to a wellbore, the set of metrics may include a first metric associated with a fraction of clay and a second metric associated with a fraction of solid included in the initial composition of the drilling mud provided to the wellbore. The one or more processors may also execute the instructions to calculate a density of the initial composition of the drilling mud as a function of the first metric associated with the fraction of the clay and the second metric associated with the fraction of the solid included in the initial composition of the drilling mud, wherein the initial composition of the drilling mud is changed to a changed composition of the drilling mud after the initial composition of the drilling mud is provided to the wellbore, and wherein the changed composition of the drilling mud includes a fraction of gasses and an estimated rock mass. The one or more processors may also execute the instructions to calculate a density of the changed composition that includes the fraction of gasses and the estimated rock mass; identify a density difference by subtracting the density of the changed composition from the density of the initial composition; identify the fraction of gasses included in the changed composition based on the density difference and the estimated rock mass; and predict a composition of the fraction of gasses included in the changed composition based on the density difference.

Aspect 15: The system of Aspect 14, further comprising one or more flow meters that measure: a mass flow rate of the initial composition of the drilling mud provided to the wellbore, and a mass flow rate of the changed composition as the changed composition exits the wellbore.

Aspect 16: The system of method of any of Aspects 14 through 15, wherein the first metric corresponds to a volumetric percentage of the clay in the initial composition of the drilling mud, and the second metric corresponds to a volumetric percentage of the solid in the initial composition of the drilling mud.

Aspect 17: The system of method of any of Aspects 14 through 16, wherein in the one or more processors execute the instructions to identify a specific gravity of rock included in the changed composition, the specific gravity of the rock included in the changed composition corresponding to the mass of the rock in a volume of the changed composition.

Aspect 18: The system of method of any of Aspects 1 through 17, wherein the specific gravity of the rock is identified by acquiring an image of the rock included in the changed composition; and performing an evaluation of the image that identifies the specific gravity of the rock by estimating the mass of the rock included in the volume of the changed composition.

Aspect 19: The system of any of Aspects 1 through 18, wherein first mass flow rate of the drilling mud provided to the wellbore is identified based on the initial composition of the drilling mud flowing through a mass flow meter.

Aspect 20: A non-transitory computer-readable storage medium having embodied thereon instructions executable by one or more processors to implement a method comprising identifying a set of metrics of an initial composition of a drilling mud provided to a wellbore. This set of metrics may include a first metric associated with a fraction of clay and a second metric associated with a fraction of solid included in the initial composition of the drilling mud provided to the wellbore. The method may also include calculating a density of the initial composition of the drilling mud as a function of the first metric associated with the fraction of the clay and the second metric associated with the fraction of the solid included in the initial composition of the drilling mud, wherein the initial composition of the drilling mud is changed to a changed composition of the drilling mud after the initial composition of the drilling mud is provided to the wellbore, and wherein the changed composition of the drilling mud includes a fraction of gasses and an estimated rock mass. The method may also include calculating a density of the changed composition that includes the fraction of gasses and the estimated rock mass; identifying a density difference by subtracting the density of the changed composition from the density of the initial composition; identifying the fraction of gasses included in the changed composition based on the density difference and the estimated rock mass; and predicting a composition of the fraction of gasses included in the changed composition based on the density difference.

What is claimed is:

1. A method comprising:

identifying a set of metrics of an initial composition of a drilling mud provided to a wellbore, the set of metrics including a first metric associated with a fraction of a clay and a second metric associated with a fraction of a solid included in the initial composition of the drilling mud provided to the wellbore;

calculating a density of the initial composition of the drilling mud as a function of the first metric associated with the fraction of the clay and the second metric associated with the fraction of the solid included in the initial composition of the drilling mud;

wherein the initial composition of the drilling mud is changed to a changed composition of the drilling mud after the initial composition of the drilling mud is provided to the wellbore;

wherein the changed composition of the drilling mud includes a fraction of gasses and an estimated rock mass; and wherein the density of the initial composition of the drilling mud is calculated by determining a constituent volumetric density of each of the clay, the solid, and a fluid within the initial composition based on the fraction of each of the clay and the solid included in the initial composition and a volumetric density of each of the clay and the solid included in the initial composition;

calculating a density of the changed composition that includes the fraction of gasses and the estimated rock mass;

identifying a density difference by subtracting the density of the changed composition from the density of the initial composition;

identifying the fraction of gasses included in the changed composition based on the density difference and the estimated rock mass;

predicting a composition of the fraction of gasses included in the changed composition based on the density difference; and adjusting a drilling operation based on the predicted composition of the fraction of gasses.

2. The method of claim 1, further comprising:

identifying a mass flow rate of the initial composition of the drilling mud provided to the wellbore; and identifying a mass flow rate of the changed composition as the changed composition exits the wellbore.

3. The method of claim 1, wherein the density of the initial composition of the drilling mud (Pmudin) is calculated by applying an equation of:

$$P\text{mudin}=[(\Phi C\text{in})*PC]+[(\Phi S\text{in})*PS]+[(1-\Phi C\text{in}-\Phi S\text{in})*P\text{fluid}],\text{ where:}$$

ΦCin is the first metric associated with the fraction of the clay included in the initial composition of the drilling mud, ΦSin is the second metric associated with the fraction of solid included in the initial composition of the drilling mud, PC is the volumetric density of the clay, PS is the volumetric density of the solid, and Pfluid is a volumetric density of the fluid included in the initial composition of the drilling mud, wherein the initial composition of the drilling mud is changed to a changed composition after the drilling mud is provided to the wellbore.

4. The method of claim 3, wherein the density of the changed composition of the drilling mud is calculated by applying an equation of:

$$P\text{mud}f=[\Phi Cf*PC]+[\Phi Sf*PS]+[\Phi*PK]+[(1-\Phi Cf-\Phi Sf-\Phi kf)*P\text{fluid}f],\ \textit{where}$$

where:

ΦCf is a fraction of the clay included in the changed composition,

ΦSf is a fraction of the solid included in the changed composition,

Φkf is a fraction of drill cuttings included in the changed composition, wherein the drill cuttings include a rock mass, PK is a volumetric density of the drill cuttings included in the changed composition, and Pfluidf is a volumetric density of a fluid included in the changed composition.

5. The method of claim 1, wherein:

the first metric corresponds to a volumetric percentage of the clay in the initial composition of the drilling mud, and the second metric corresponds to a volumetric percentage of the solid in the initial composition of the drilling mud.

6. The method of claim 1, further comprising:

identifying a specific gravity of a rock included in the changed composition, the specific gravity of the rock included in the changed composition corresponding to the mass of the rock in a volume of the changed composition.

7. The method of claim 6, wherein the specific gravity of the rock is identified by:

acquiring an image of the rock included in the changed composition; and performing an evaluation of the image that identifies the specific gravity of the rock by estimating the mass of the rock included in the volume of the changed composition.

8. The method of claim 6, further comprising:

calculating a density of drill cuttings (PCut), by applying an equation of:

$$P\text{Cut}=(\text{the specific gravity of the rock})*(\text{density of water})*[(\text{a measured volume of the rock})/(\text{a drilled volume per-unit-time})].$$

9. The method of claim 8, further comprising:

identifying the drilled volume (V) per-unit-time (Δ Time) by applying an equation of:

$$V=(\text{drill bit area})*(\text{penetration rate})*(\Delta\ \text{Time}).$$

10. The method of claim 4, further comprising:

calculating a change in fluid density (ΔPfluid) by applying:

$$\Delta P\text{fluid}=P\text{fluid}f-P\text{mudin}-[\Phi kf*PK]$$

11. The method of claim 7, further comprising:

estimating a fraction of gas compositions included in the changed composition based on a relationship of:

$$\Delta P\text{fluid}=\Sigma[(\text{a fraction concentration of the gasses})*(\text{gas density})],\text{ when:}$$

Σ (the fraction concentration of the gasses)=1, and

0≤the fraction of the gasses≤1.

12. The method of claim 2, wherein the mass flow rate of the initial composition of the drilling mud provided to the wellbore is identified based on the initial composition of the drilling mud flowing through a mass flow meter.

13. The method of claim 12, wherein the mass flow rate of the changed composition is identified based at least in part on a portion of the changed composition flowing through the mass flow meter or a second mass flow meter.

14. A system comprising:

a memory; and one or more processors that execute instructions out of the memory to:

identify a set of metrics of an initial composition of a drilling mud provided to a wellbore, the set of metrics including a first metric associated with a fraction of a clay and a second metric associated with a fraction of a solid included in the initial composition of the drilling mud provided to the wellbore;

calculate a density of the initial composition of the drilling mud as a function of the first metric associated with the fraction of the clay and the second metric associated with the fraction of the solid included in the initial composition of the drilling mud:

wherein the initial composition of the drilling mud is changed to a changed composition of the drilling mud after the initial composition of the drilling mud is provided to the wellbore;

wherein the changed composition of the drilling mud includes a fraction of gasses and an estimated rock mass; and wherein the density of the initial composition of the drilling mud is calculated by determining a constituent volumetric density of each of the clay, the solid, and a fluid within the initial composition based on the fraction of each of the clay and the solid included in the initial composition and a volumetric density of each of the clay and the solid included in the initial composition;

calculate a density of the changed composition that includes the fraction of gasses and the estimated rock mass;

identify a density difference by subtracting the density of the changed composition from the density of the initial composition;

identify the fraction of gasses included in the changed composition based on the density difference and the estimated rock mass;

predict a composition of the fraction of gasses included in the changed composition based on the density difference; and adjusting a drilling operation based on the predicted composition of the fraction of gasses.

15. The system of claim 14, further comprising:

one or more mass flow meters that measure:

a mass flow rate of the initial composition of the drilling mud provided to the wellbore, and a mass flow rate of the changed composition as the changed composition exits the wellbore.

16. The system of claim 14, wherein:

the first metric corresponds to a volumetric percentage of the clay in the initial composition of the drilling mud, and the second metric corresponds to a volumetric percentage of the solid in the initial composition of the drilling mud.

17. The system of claim 14, wherein in the one or more processors execute the instructions to:

identify a specific gravity of rock included in the changed composition, the specific gravity of the rock included in the changed composition corresponding to the mass of the rock in a volume of the changed composition.

18. The system of claim 17, wherein the specific gravity of the rock is identified by:

acquiring an image of the rock included in the changed composition; and performing an evaluation of the image that identifies the specific gravity of the rock by estimating the mass of the rock included in the volume of the changed composition.

19. The system of claim 15, wherein the mass flow rate of the initial composition of the drilling mud provided to the wellbore is identified based on the initial composition of the drilling mud flowing through the one or more mass flow meters.

20. A non-transitory computer-readable storage medium having embodied thereon instructions executable by one or more processors to implement a method comprising:

identifying a set of metrics of an initial composition of a drilling mud provided to a wellbore, the set of metrics including a first metric associated with a fraction of a clay and a second metric associated with a fraction of a solid included in the initial composition of the drilling mud provided to the wellbore;

calculating a density of the initial composition of the drilling mud as a function of the first metric associated with the fraction of the clay and the second metric associated with the fraction of the solid included in the initial drilling mud:

wherein the initial composition of the drilling mud is changed to a changed composition of the drilling mud after the initial composition of the drilling mud is provided to the wellbore;

wherein the changed composition of the drilling mud includes a fraction of gasses and an estimated rock mass; and wherein the density of the initial composition of the drilling mud is calculated by determining a constituent volumetric density of each of the clay, the solid, and a fluid within the initial composition based on the fraction of each of the clay and the solid included in the initial composition and a volumetric density of each of the clay and the solid included in the initial composition;

calculating a density of the changed composition that includes the fraction of gasses and the estimated rock mass;

identifying a density difference by subtracting the density of the changed composition from the density of the initial composition;

identifying the fraction of gasses included in the changed composition based on the density difference and the estimated rock mass;

predicting a composition of the fraction of gasses included in the changed composition based on the density difference; and adjusting a drilling operation based on the predicted composition of the fraction of gasses.

* * * * *